US006551181B2

(12) United States Patent
Lee

(10) Patent No.: US 6,551,181 B2
(45) Date of Patent: Apr. 22, 2003

(54) ABRASIVE WHEEL

(75) Inventor: Chang Hyun Lee, Kyungki (KR)

(73) Assignee: EWHA Diamond Ind. Co., Ltd. (KR)

( * ) Notice: Subject to any disclaimer, the term of this patent is extended or adjusted under 35 U.S.C. 154(b) by 0 days.

(21) Appl. No.: 09/944,704

(22) Filed: Aug. 31, 2001

(65) Prior Publication Data

US 2003/0060152 A1 Mar. 27, 2003

(51) Int. Cl.[7] ..... B23F 21/03
(52) U.S. Cl. ..... 451/548; 451/550
(58) Field of Search ..... 451/548, 549, 451/550, 551, 546

(56) References Cited

U.S. PATENT DOCUMENTS 1,470,957 A * 10/1923 Cavicchi
2,039,578 A * 5/1936 Blount
3,745,719 A * 7/1973 Oswald
6,196,911 B1 * 3/2001 Preston et al. ..... 451/548
6,273,805 B1 * 8/2001 Sunagawa ..... 451/296
6,277,017 B1 * 8/2001 Ji ..... 451/547
6,299,522 B1 * 10/2001 Lee ..... 451/548

* cited by examiner

*Primary Examiner*—Eileen P. Morgan
(74) *Attorney, Agent, or Firm*—Piper Rudnick; Jefferson Perkins

(57) ABSTRACT

An abrasive wheel to grind or cut a variety of materials comprising a core part fixed to a tool transmitting motive power and long tips and short tips alternately attached on the base surface of a shank around the core part. The tips are arranged to cover the base surface with space therebetween at predetermined intervals along the circumference of the shank.

7 Claims, 5 Drawing Sheets

ABRASIVE WHEEL

FIELD OF THE INVENTION

The present invention relates to an abrasive wheel to grind or cut a variety of materials such as granite, brick, concrete block or the like by using abrasive means, and more particularly, to an abrasive wheel which permits the reduction in friction heat generated during the abrasive operation through an increased cooling action and at the same time permits effective discharge of cut sludge by causing an increased difference in the velocity of sludge flow at radially remote and close positions within an abrasive segment.

BACKGROUND OF THE INVENTION

A conventional abrasive wheel 100, as shown in FIG. 1, comprises a cup type core part 120 with an opening H for mounting a tool transmitting motive power (not shown) at the center, sucking holes 120H distributed around the opening H and a shank 110 around the core part 120. The shank 110 includes ordinary tips 200 circumferentially on its base. The ordinary tips 200 act as cutting blades by means of welding, soldering or adhesion. The tips consist of a calcined product including diamond, CBN or other abrasives (hereinafter referred to as "abrasives") and powder of the material comprising metals, resins, ceramics or the like for holding or binding together the abrasives and allowing continuous regenerating action.

In that case, the core part 120 is a cup with a relatively large diameter and the suction holes 120H formed on the core part represent mere holes for flow under the sucking force of a dust collector (not shown).

The abrasive work using such a conventional abrasive wheel 100 is conducted in dry process, and even with a dust collector operating, a considerable amount of dust from the body under abrasion tends to be discharged to the outside due to the centrifugal force of the abrasive wheel. The dust collecting efficiency is decreased as some dust inevitably spills outside the safety cover wherein the hood for the dust collector is provided and the working environment is polluted with the dust, causing a problem. Accordingly, the conventional abrasive wheel, which depends on the cooling method or heat dissipating method with a low efficiency based on the mere rapid chip extracting function of a dust collector, suffers from carbonization or oxidization of the abrasives over a long period of continuous operation due to the increase in the thermal shock exerted on the abrasives including diamond. The shock originates from the friction heat between the body under abrasion and the abrasive wheel, whereby a premature falling-off of the tip 200 takes place.

In addition, the difference between the rotation speed of the abrasive segments 130 at their radially inner positions and their outer positions of the shank 110 is very meager. The sucking force by the dust collector is not oriented in line with the discharging direction of the slurry flow. Thus, the discharge of slurry is not smoothly conducted and the abrasion performance is reduced.

FIG. 2 illustrates an abrasive segment that failed to result in a uniform wear because there was no difference in the shape of the radially inner and outer part of the abrasive segment. As a result, the outer part of the abrasive segment is worn out ahead of time.

SUMMARY OF THE INVENTION

Accordingly, the object of the present invention which is devised to resolve the above-described disadvantage is to provide an abrasive wheel, wherein air sucking holes are located at positions relatively far from the center of the abrasive wheel and proximate to the abrasive segments for the ultimate purpose of promoted cooling. The difference between the somewhat radially inward velocity of the flow, including cut sludge at radially distal positions and proximal positions within the abrasive segments, is large enough to facilitate the discharge of the sludge to help improve the cutting performance. Furthermore, the combined segments, each comprising a long tip and a short tip, are attached to the circular shank at regular intervals to induce uniform wear of the abrasive segments.

To accomplish the above objects, an abrasive wheel to grind or cut a variety of materials in accordance with the present invention comprises a core part fixed to a tool transmitting motive power and long tips and short tips alternately attached on the base surface of a shank around the core part. The tips are arranged to cover the base surface with space therebetween at predetermined intervals along the circumference of the shank.

The long and short tips are preferably shaped so that the tips circumferential area increases with the increasing distance from the central part.

The long and short tips may be shaped so that they have a certain curved portion in the direction of rotation.

A suction hole may be located between the long tips and inside of the short tip. The suction hole may be surrounded by an inclined wall surface to guide cut chips according to the rotation direction of an abrasive wheel.

DETAILED DESCRIPTION OF THE INVENTION

The present invention will be described in detail with regard to some preferred embodiments in conjunction with the attached drawings.

Figure 3:
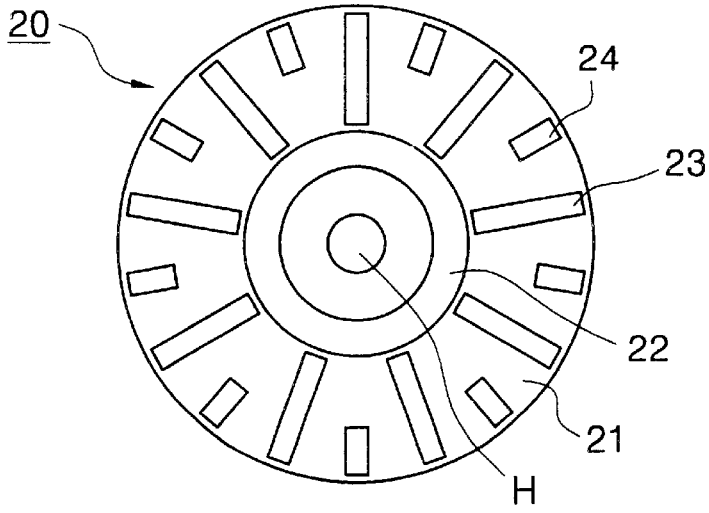
FIG. 3 shows the bottom view of an abrasive wheel according to the first embodiment of the present the invention.

As shown in FIG. 3, the core part 22 with an opening H in which a tool transmitting motive power is to be mounted with its output end is positioned in the center and the shank 21 in the form of a disk extends around the core part 22. The shank 21 is provided on its base surface with alternatively and regularly arranged segments in the form of long tips 23 and short tips 24.

The radius of the disk-formed shank 21 is formed larger than the radius from the mounting opening H to the end of the core part 22.

Figure 4:
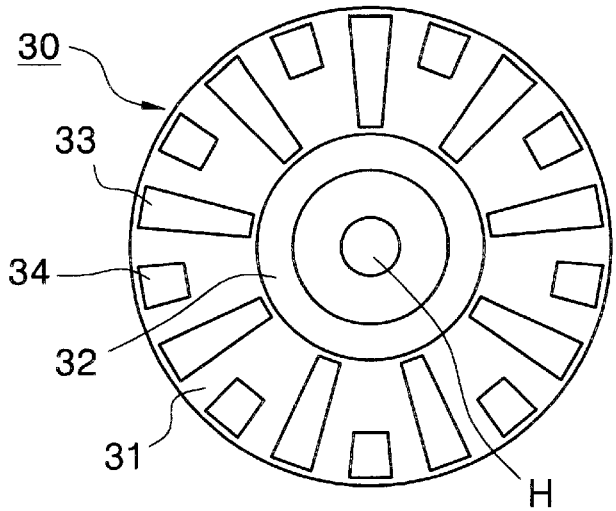
FIG. 4 shows the bottom view of an abrasive wheel according to the second embodiment of the present the invention.

Preferably, according to the second embodiment of the invention, as shown in FIG. 4, the long tips 33 as well as the short tips 34 are shaped as to have a larger width with a radius.

Figure 5:
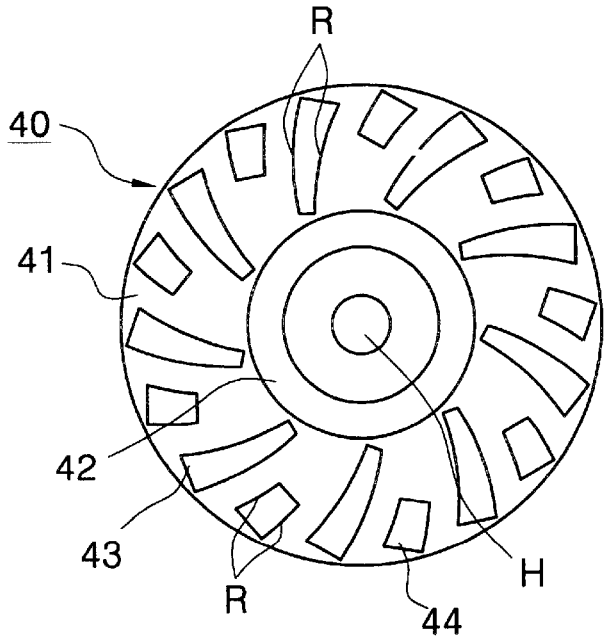
FIG. 5 shows the bottom view of an abrasive wheel according to the third embodiment of the present the invention.

Further, the long tips 33 as well as the short tips 34 are preferably shaped to have a certain curvature R in the direction of rotation according to the third embodiment of invention as shown in FIG. 5.

Figure 6A:
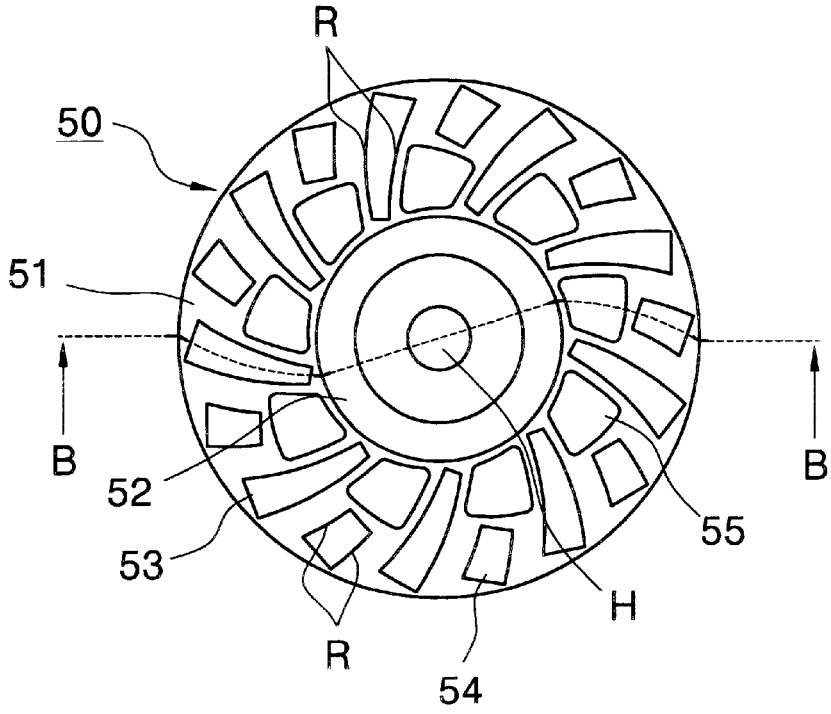
FIG. 6A shows the bottom view of an abrasive wheel according to the fourth embodiment of the present the invention.
Figure 6B:
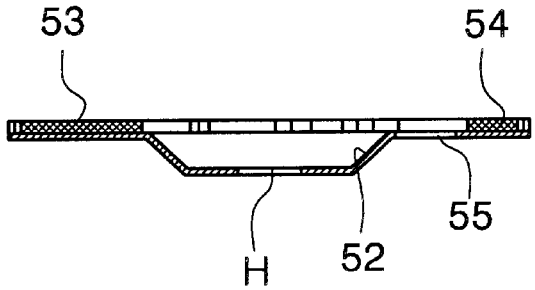
FIG. 6B shows a cross-sectional view of the abrasive wheel of FIG. 6A along the line B—B.

On the other hand, suction holes 55 are formed between the neighboring long tips 53 and inside of the short tips 54 as shown in FIGS. 6A and 6B.

Figure 7:
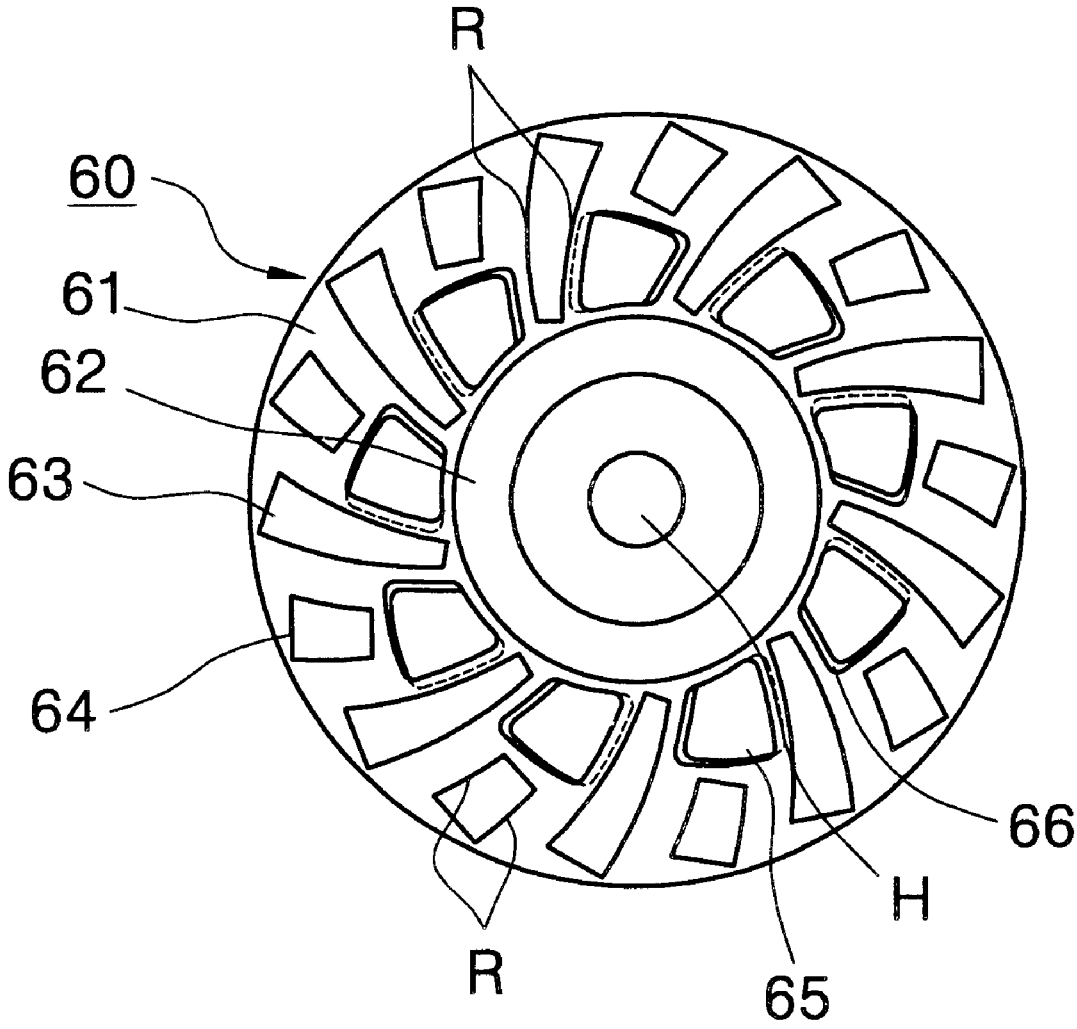
FIG. 7 shows the bottom view of the abrasive wheel in FIG. 6A, additionally illustrating the inclined surface of air-sucking holes.

It is preferable that the side walls defining the suction holes 55 are provided as inclined surfaces 66 in the rotation direction of the abrasive wheel to guide the flow of the chips as seen in FIG. 7.

The description of construction is given in more detail below.

FIG. 3 shows the view of a bottom surface for the abrasive wheel 20 constructed according to the first embodiment of the invention.

This represents the basic structure of the present invention wherein the segments in the form of long rectangular tip 23 and short rectangular tip 24 are attached alternately on the base surface of a shank 21 along the circumference. Those tips are attached by means of welding, soldering, adhesion or the like in such a way that the outer ends of the long and short tips 23 and 24 are aligned.

Accordingly, the area of the tips is larger on the outer circumferential part of the wheel than on the inner circumferential part, when viewed overall.

This is to achieve a uniform abrasive operation over all surfaces regardless of radial position by allocating more abrasive area to the outer circumferential part where fresh abrasion begins relatively early and more abrasive work is charged due to longer circumferential area per unit radial length.

FIG. 4 shows a view of a base surface for the abrasive wheel 30 constructed according to the second embodiment of the present invention.

This corresponds to the first embodiment except that the shapes of the tips themselves vary in such a way as to expand toward the perimeter of the wheel like a sector, in contrast to the first embodiment in which the circumferential tip area varies only in an overall manner with the radial tip width remaining the same.

This embodiment may be superior to the first embodiment in rationality and effectiveness on the ground that the local circumferential area or width of a tip increases gradually from the center of the abrasive wheel to the outer perimeter of the wheel.

FIG. 5 shows a view of a base surface for the abrasive wheel 40 constructed according to the third embodiment of the present invention.

This construction is similar to that of the second embodiment, only with the difference that the segments comprising long tips 43 and short tips 44 have a predetermined curvature R relative to the rotating direction of the abrasive wheel 40.

The respective radial edges of the long and short tips 43 and 44 may be determined, for example, by allotting the same curvature but different centers of curvature.

The drawing of FIG. 6A shows a view of a base surface for the abrasive wheel 50 constructed according to the fourth embodiment of the present invention.

This is substantially the same as the third embodiment, different only in that sucking holes are formed on the shank 51 at positions between the neighboring long tips 53 and inside the short tips 54.

The suction holes 55 are preferably chosen as large as possible because the large size contributes to an improved discharge of cut chips and the light weight of the product to minimize the power needed for operating the actuator tool.

The suction holes 55 may be formed as approximate rectangles with their corners rounded up, as shown in FIG. 6A.

As shown in FIG. 7, the side walls defining the suction holes 55 are provided as inclined surfaces 66 in the rotation direction of the abrasive wheel 60 to facilitate the discharge of cut chips by guiding them.

The major functional features of the abrasive wheel constructed as above according to the invention are now described.

The alternate arrangement of long and short tips 23 and 24, according to the first embodiment results in a larger effective cutting area in the outer peripheral zone than in the zone near the core part. This is manifested more remarkably in the second and subsequent embodiments because in those cases the tips (33, 34, 43, 44, 53, 54, 63, 64) themselves vary in width along the radius as well.

Figure 1A:
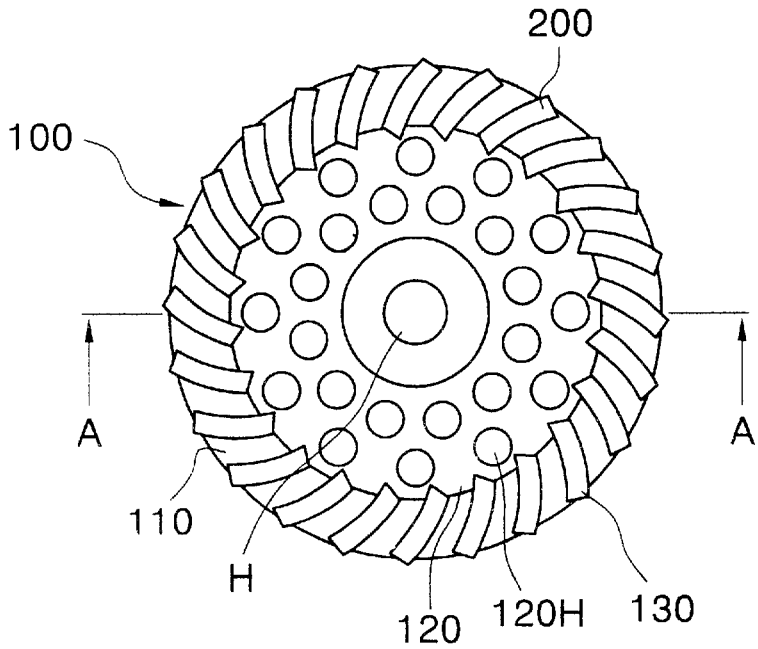
FIG. 1A CONVENTIONAL ART
FIG. 1A shows a bottom view of a conventional abrasive wheel.
Figure 1B:
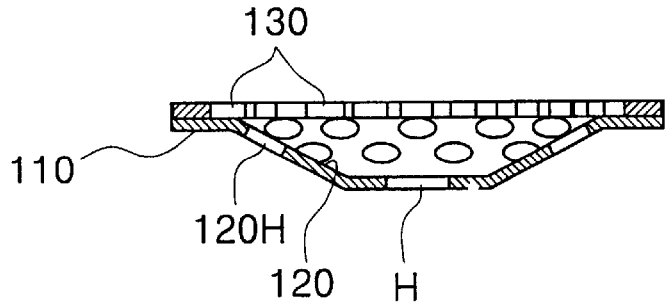
FIG. 1B CONVENTIONAL ART
FIG. 1B shows a cross-sectional view of the abrasive wheel of FIG. 1A along the line A—A.
Figure 2:
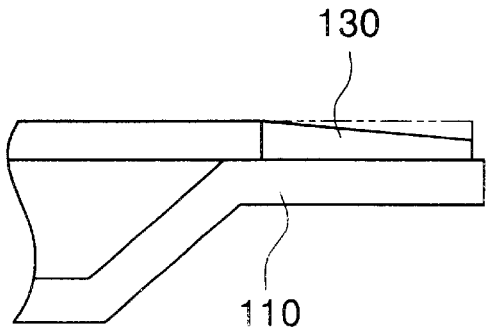
FIG. 2 CONVENTIONAL ART
FIG. 2 shows an enlarged cross-sectional view of a cut-off part illustrating an unbalanced wear on a conventional segment.

The cutting work to be done by the circumferential area of the wheel along the unit radial length onto the material being cut is larger near the outer peripheral boundary than near the core part. Additionally, the circumferential velocity is also higher near the outer peripheral boundary than near the core part. Therefore, the conventional abrasive wheel 100, as depicted in FIG. 1, would experience an uneven wear or premature wear on the outer edge because the active cutting segments have about the same area along the direction of a radius. In contrast, the cutting wheel, according to the present invention could avoid uneven wear on the cutting tips because ample cutting area is provided in the vicinity of the outer peripheral zone.

Further, the flow containing cut chips having a high velocity near the peripheral zone is predominant in quantity compared to the slow flow near the zone close to the core part because of the arrangement and the shape of cutting chips. The high speed of chip flow and the marked difference in velocity depending on radial positions would contribute to the overall easy discharge of the chips. This can be made possible mainly by virtue of the structure involving much longer tips than corresponding conventional ones.

Suction of air is improved and premature falling out of cutting tips as the result of thermal oxidation or carbonization due to friction heat during cutting operation is avoided since the mounting opening for mounting the output end of the tool transmitting motive power is located in the center and suction holes bounded by the sides inclined inwardly of the shank are arranged on the bottom of the shank in a uniform manner throughout the circumference. Thus, the air can be sucked through the suction holes positioned slantingly in conformity with the direction of rotation during the rotation of the shank to thereby enhance the cooling effect and the cutting performance.

The segments, which consist of two kinds of members, that is, the long tips and the short tips, are arranged so as to be larger in area in the vicinity of the outer boundary of the disk shank than in the region close to the core. As a result, uniform wear of tips is attained and stable cutting work can be expected to give a smooth and neat cutting surface of the material being cut.

Other important advantages and characteristics which were already elucidated fully are not repeated.

Naturally, air-sucking holes may be optionally formed on the shank by drilling at the positions between the neighboring long tips and inside the short tips in the case of the first three embodiments as well.

It is to be understood that, while the invention was described with respect to some specific embodiments, the invention is not restricted only to those embodiments and a variety of modifications and alterations would be possible to a man skilled in the art by referring to the description or drawings presented here and within the spirit of the invention and thus those modifications or alterations are intended to fall within the scope of the invention, which scope should be limited only by the attached claims.

What is claimed is:

1. An abrasive wheel to grind or cut a variety of raw materials, wherein said abrasive wheel comprises:

a shank having a core part fixed to an end of a tool transmitting motive power thereto, the core part having a radius with respect to the center of the abrasive wheel and an inner and outer circumference; and a base working surface facing said material, the base working surface being formed between an inner radius and an outer radius of the shank with respect of to the shank center and being adjacent to the outer circumference of the core part;

long machining tips having a width and a predetermined first length attached on the base working surface of the shank wherein the long tips are arranged to be consistent with a radial direction of the wheel and at predetermined intervals along a circumference of the shank; and short machining tips having a width and a predetermined second length which is shorter than the predetermined first length of the long tips, said short tips being attached towards the outer circumference of the base working surface of the shank, wherein each the short tips are arranged to be consistent with the radial direction of the wheel and between the long tips and the widths of long and short tips are so shaped as to get wider with respect to the radial direction from the base working surface of the inner radius to the base working surface of the outer radius.

2. The abrasive wheel according to claim 1, wherein at least two opposite edges of the long and short tips have a predetermined curvature in the direction of rotation.

3. The abrasive wheel according to claim 2, further comprising suction holes are formed on the base working surface at positions between the neighboring long tips and between the core part and the short tips.

4. The abrasive wheel according to claim 1, wherein at least two opposite edges of the long and short tips have a predetermined curvature in the direction of rotation.

5. The abrasive wheel according to claim 4, further comprising suction holes which are formed on the base working surface at positions between the neighboring long tips and between the core part and the short tips.

6. The abrasive wheel according to claim 5, wherein the shank has a predetermined thickness and the suction holes are inclined toward the radial direction of the wheel and having a predetermined angle with respect to the thickness of the shank to guide cut materials away from the raw materials as the abrasive wheel rotates.

7. The abrasive wheel according to claim 1, further comprising suction holes which are formed on the base working surface at positions between the neighboring long tips and between the core part and the short tips.

* * * * *